US006135507A

United States Patent [19]

Hamby et al.

[11] Patent Number: 6,135,507

[45] Date of Patent: Oct. 24, 2000

[54] MULTI-WRITE SAMPLE DRUG LABEL SYSTEM

[75] Inventors: Scott Hamby; Joe Scherrer, both of Indianapolis, Ind.

[73] Assignee: Moore North America, Inc., Grand Island, N.Y.

[21] Appl. No.: 09/303,419

[22] Filed: May 3, 1999

[51] Int. Cl.[7] ..... B42D 15/00

[52] U.S. Cl. ..... 283/81; 283/67; 283/70; 283/79; 283/80; 283/81; 283/101; 428/43; 462/22; 462/24; 462/28; 462/39

[58] Field of Search ..... 283/101, 900, 283/67, 70, 105, 79, 80, 81; 462/22, 24, 28, 39; 428/43

[56] References Cited

U.S. PATENT DOCUMENTS

| | | | |
|---|---|---|---|
| 5,547,227 | 8/1996 | Laurash et al. | 283/81 |
| 5,800,893 | 9/1998 | Harden | 482/40.1 |
| 5,837,338 | 11/1998 | Rich et al. | 482/42.3 |

*Primary Examiner*—Willmon Fridie, Jr.
*Assistant Examiner*—Daniel Phan
*Attorney, Agent, or Firm*—Nixon & Vanderhye PC

[57] ABSTRACT

A multi-part (e.g. three part) business form is particularly suited for use in dispensing sample drugs where it is necessary to have a label to be placed on a sample medication container, a like label to be placed on the patient's chart, and a record sheet, to be placed in the sample medication distribution log. First and second top and intermediate, respectively, label parts each have a face ply having pressure sensitive adhesive on a back surface and in engagement with an adhesive release coated liner ply, and a third, bottom, paper part underlies the first and second parts. Common non-variable indicia is imaged on the first part face ply, the second part face ply, and the third part, and the parts are releasably connected together (e.g. by permanent adhesive and a line of weakness, adjacent the top edges of the parts) so that at least some of the common indicia is in alignment. Carbonless coatings transfer indicia imaged on the first part face ply to the second part face ply and to the third part. The label parts each comprise a plurality of (e.g. six) labels formed in (e.g. die cut from) the face ply, and each having nonvariable common indicia. Preferably each label has a corner devoid of adhesive to facilitate easy separation from the liner ply. At least the third part preferably is three hole punched so that it can easily be kept in a binder. In order to provide sufficient durability of the parts and plies, yet allow appropriate image transfer, the face plies of the first and second parts are typically each between about 10–18 pound bond paper, and the liner plies of the first and second parts are each between about 10–15 pound liner paper, and the third part is preferably between about 10–25 pound bond paper.

20 Claims, 5 Drawing Sheets

MULTI-WRITE SAMPLE DRUG LABEL SYSTEM

BACKGROUND AND SUMMARY OF THE INVENTION

In the practice of medication distribution, it is highly desirable to have appropriate record keeping, and to make as simple as possible the filling out of the forms necessary for proper record keeping. While particular systems for dispensing and record keeping have been devised, such as shown in U.S. Pat. Nos. 4,277,089 and 4,799,712 and co-pending application Ser. No. 08/864,739 filed May 28, 1997 (atty. dkt. 263-1634), heretofore a system has not been provided which specifically facilities dispensing and tracking of sample drugs by clinics. Clinicians who dispense sample drugs are required to submit documentation to the patient, keep documentation in the patient's file, and keep a log which advises to whom all of a number of samples have been distributed. Typically the clinician must fill out several forms, and the record keeping process is cumbersome.

According to the present invention a method of dispensing sample drugs, and a multi-part business form facilitating the dispensing and record keeping requirements, are provided which are particularly (though not exclusively) adapted for sample drugs, which are simple and substantially foolproof. A clinician is required only to write or typewrite information for dispensing and record keeping of sample medications one time. By suitable image transfer devices associated with the multi-part business form, the indicia imaged on one part of the multi-part form is transferred to other parts. The multi-part form has two sets of labels, one label designed for use on the medication to be dispensed, the other label which can be applied to a patient's chart, and a third part of the form is used for record keeping, preferably having holes punched therein to facilitate maintenance in a binder. The labels are easily removable, and the paper plies making up the parts of the form have an optimum weight so that they perform their desired functions effectively, yet allow appropriate image transfer despite the number of plies of the form.

According to one aspect of the present invention a multi-part (e.g. three part, or possibly more) business form is provided comprising the following components: A first, top, label part including a face ply having pressure sensitive adhesive on a back surface thereof and in engagement with an adhesive release coated liner ply. A second, intermediate, label part including a face ply having pressure sensitive adhesive on a back surface thereof and in engagement with an adhesive release coated liner ply. A third, bottom, paper part. Common non-variable indicia imaged on the first part face ply, the second part face ply, and the third part, related to drug dispensing. The first, second, and third parts releasably connected together so that at least some of the common indicia thereon is in alignment. And, carbonless image transfer means for transferring indicia imaged on the first part face ply to the second part face ply and to the third part.

Preferably the label parts each comprise a plurality of labels formed in (e.g. die cut from) the face ply thereof, and each having common non-variable indicia (such as "patient's name", "drug name", "quantity", "expiration date", "directions", etc.). Desirably the adhesive is pattern coated so that adhesive-free lift tabs are provided; that is each label has a corner devoid of adhesive to facilitate easy separation from the liner ply. Holes may be formed (e.g. punched) in at least the third part (preferably all parts) remote from where the parts are releasably connected together, to facilitate mounting the third part in a binder, such as a three ring binder or any other suitable binder having mechanical fasteners. In one embodiment the holes are in a side edge of the third part when viewing the indicia thereon in the normal, upright, readable manner, and the parts are releasably connected together at a top edge of each, substantially perpendicular to the side edge. For example the parts may be releasably connected together by permanent adhesive adjacent the top edge of each, with a line of weakness between the adhesive and the rest of each of the parts.

The image transfer means may comprise any suitable conventional image transfer means. For example self-contained carbonless coatings may be provided on the face ply of the second part, and on the top face of the third part. Alternatively the image transfer means may comprise CB first and second part liner plies, a CF second part face ply, and a CF third paper part face in operative engagement with the second part CB liner ply. Any other suitable conventional carbonless transfer coatings, layers, or sheets, or the like, may also or alternatively be provided.

Typically the non-variable common indicia relates to the distribution of sample drugs, and each of the plurality of first part labels is dimensioned to fit on a sample container of drugs, each of the plurality of second part labels is dimensioned to fit on a patient chart, and the third part is dimensioned to fit in a distribution log binder. In order to provide sufficient body and strength so as to properly perform their functions, yet facilitate appropriate image transfer despite the relative thickness of the multi-part form, it is preferred that the face plies of the first and second parts are each 10–18 pound bond paper (e.g. a 13 pound face ply for the first part, and a 15 pound face ply for the second part), and the liner plies of the first and second parts are each about 10–15 pound liner paper (e.g. 13 pound liners), and the third part is 10–25 pound bond paper (preferably about 15 pound bond paper). The term "pound" as used with respect to paper weights herein means number of pounds per 500 17×22 inch sheets.

According to another aspect of the present invention there is provided a method of dispensing sample drugs, and record keeping therefor, utilizing a multi-part business form comprising: a first, top, label part including a face ply having a plurality of labels formed therein and having pressure sensitive adhesive on a back surface thereof and in engagement with a liner ply; a second, intermediate, label part including a face ply having a plurality of labels formed therein and having pressure sensitive adhesive on a back surface thereof and in engagement with a liner ply; a third, bottom, paper part; common non-variable indicia imaged on the first part face ply, the second part face ply, and the third part related to drug dispensing; the first, second and third parts releasably connected together so that at least some of the common non-variable indicia thereon is in alignment; and carbonless image transfer means for transferring indicia imaged on the first part face ply to the second part face ply and to the third part. The method comprises: (a) Imaging variable indicia on the face ply of one label of the first part, including patient name indicia, so that the variable indicia is transferred by the image transfer means to a label of the second part, and a portion of the third part. (b) Removing the imaged label of the first part and placing it on a container of sample drugs. (c) Removing the imaged label of the second part and placing it on a chart for the patient whose name is imaged thereon. (d) Repeating (a)–(c) for at least one other label of each of the first and second parts. And, (e) after a plurality of labels of the first and second parts have been removed, separating the third part from the first and second parts, and inserting the third part into a sample medication distribution log.

Preferably a corner of each of the plurality of labels has no pressure sensitive adhesive thereon, in which case (b) and (c) are practiced by grasping the label at the corner with no adhesive, and pulling the label away from the liner while grasping the corner. Typically at least the third part has holes punched therein, and (e) is then practiced by placing the third part in a binder having fastening elements passing through the holes (e.g. rings of a binder). Typically the parts are connected together along one edge thereof by permanent adhesive and a line of weakness, in which case (e) is practiced in part by tearing along the line of weakness. The face plies of the first and second parts are typically 10–18 pound bond paper, and the liner plies of the first and second parts are 10–15 pound liner paper, and (a) may be practiced by handwriting with an impression writing impression (such as a ballpoint pen or pencil), although (a) may also be practiced by typewriting.

According to yet another aspect of the present invention a multi-part (e.g. three part) business form is provided comprising the following components: A first, top, label part including a face ply having pressure sensitive adhesive on a back surface thereof and in engagement with an adhesive release coated liner ply. A second, intermediate, label part including a face ply having pressure sensitive adhesive on a back surface thereof and in engagement with an adhesive release coated liner ply. A third, bottom, paper part. Common non-variable indicia imaged on the first part face ply, the second part face ply, and the third part. The first, second, and third parts releasably connected together so that at least some of the common indicia thereon is in alignment. Carbonless image transfer means for transferring indicia imaged on the first part face ply to the second part face ply and to the third part. And, wherein the face plies of the first and second part are 10–18 pound bond paper, and wherein the liner plies of the first and second parts are 10–15 pound liner paper. The details of the form may be as described above with respect to the first aspect of the invention. Also various indicia may be provided on the forms providing instructions as to their use, and what is done with each; for example "drug label" could be printed in red on the first part face ply, "patient chart" printed in red on the second part face ply, and "sample medication distribution log" printed in red on the third part top face. For the first and second parts, not the entire part needs to be a label part, but rather the release liner and adhesive can be provided on only a part of the face ply, that is the face ply can have a larger area than the liner ply.

It is the primary object of the present invention to facilitate simple, effective, and full proof dispensing and record keeping in association with sample drugs. This and other objects of the invention will become clear from an inspection of the detailed description of the invention, and from the appended claims.

DETAILED DESCRIPTION OF THE DRAWINGS

Figure 1:
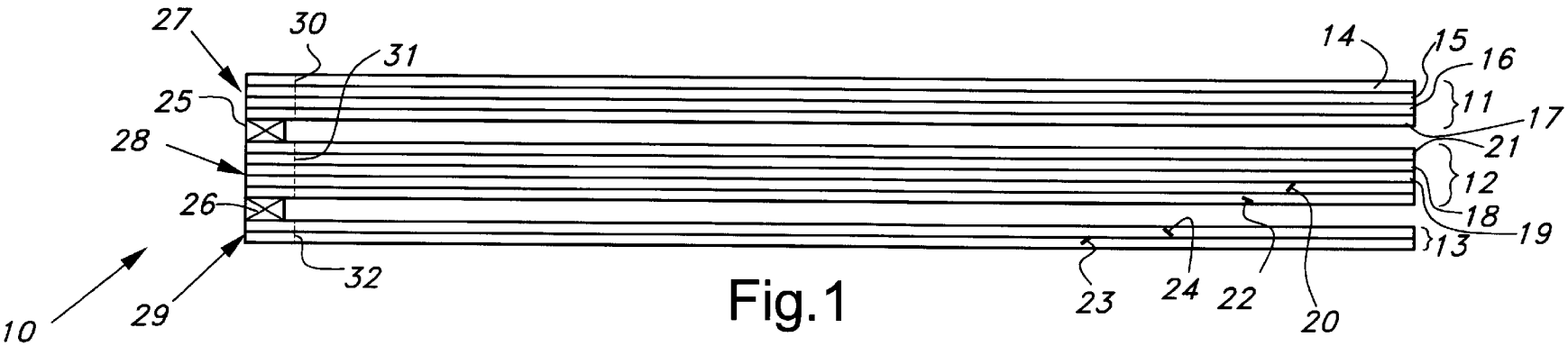
FIG. 1 is a side schematic view illustrating the various plies of each of the parts of an exemplary business form according to the present invention.
Figure 6:
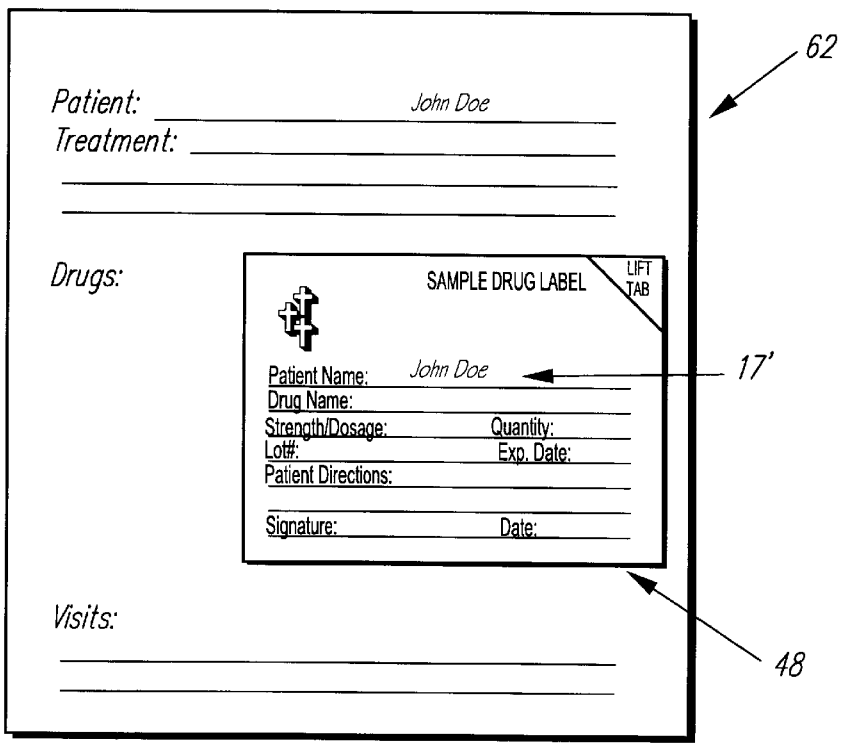
FIG. 6 is a top perspective view showing one of the labels from the second part of FIG. 3 placed on a patient chart.

An exemplary multi-part business form according to the present invention is shown schematically at 10 in FIG. 1. In FIG. 1 in order to illustrate various plies, layers, and coatings, the relative dimensions between the same are exaggerated. In actuality the coatings of carbonless material and adhesive would not be visible with the naked eye, and the paper thicknesses would be, relatively speaking, much greater than illustrated in FIG. 1.

Figure 2:
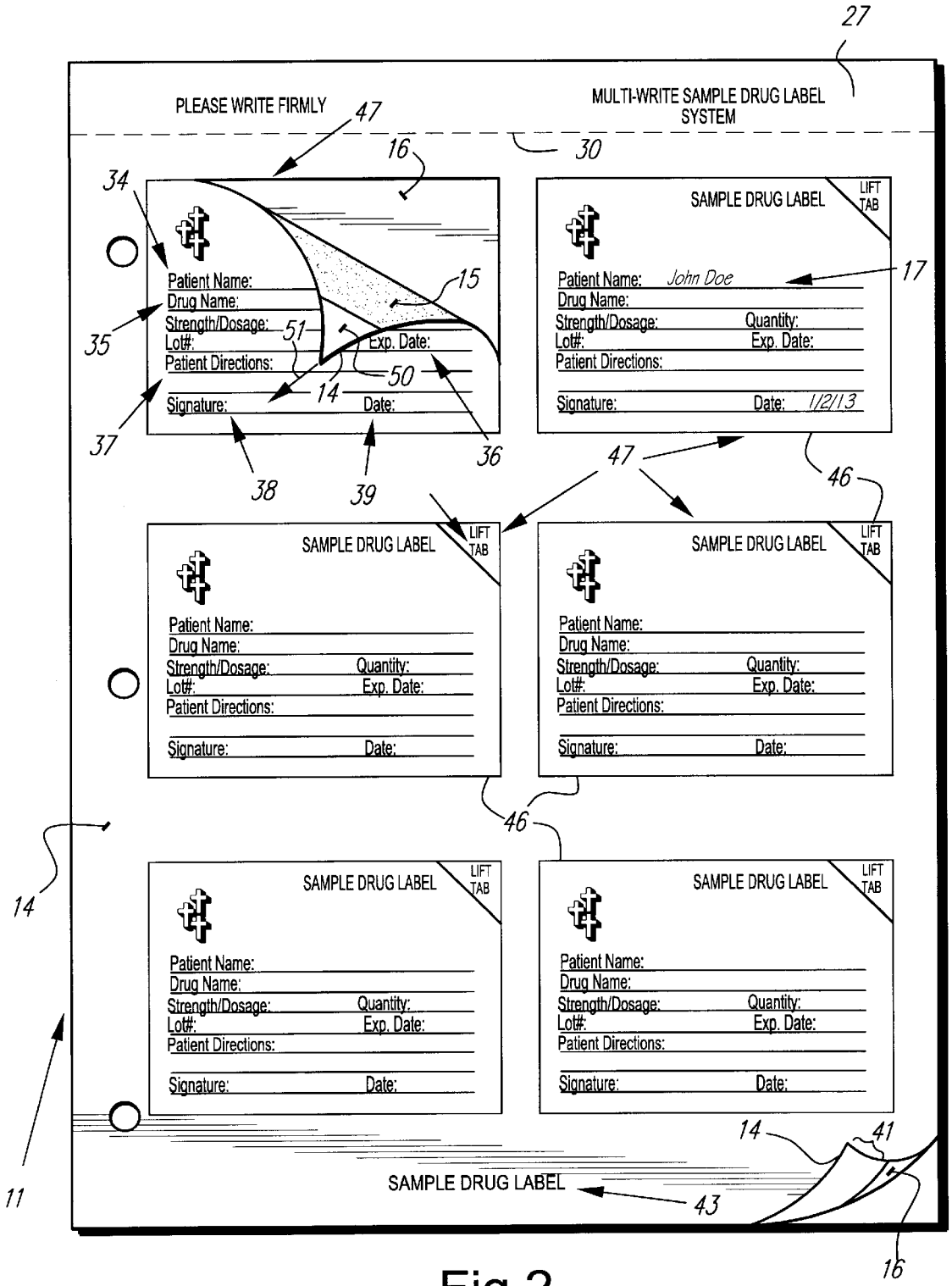
FIGS. 2, 3, and 4 are, respectively, top plan views of each of the first, second, and third parts, respectively, of the exemplary form of FIG. 1, FIGS. 2 and 3 showing one of the labels thereon being peeled away from the liner ply.
Figure 3:
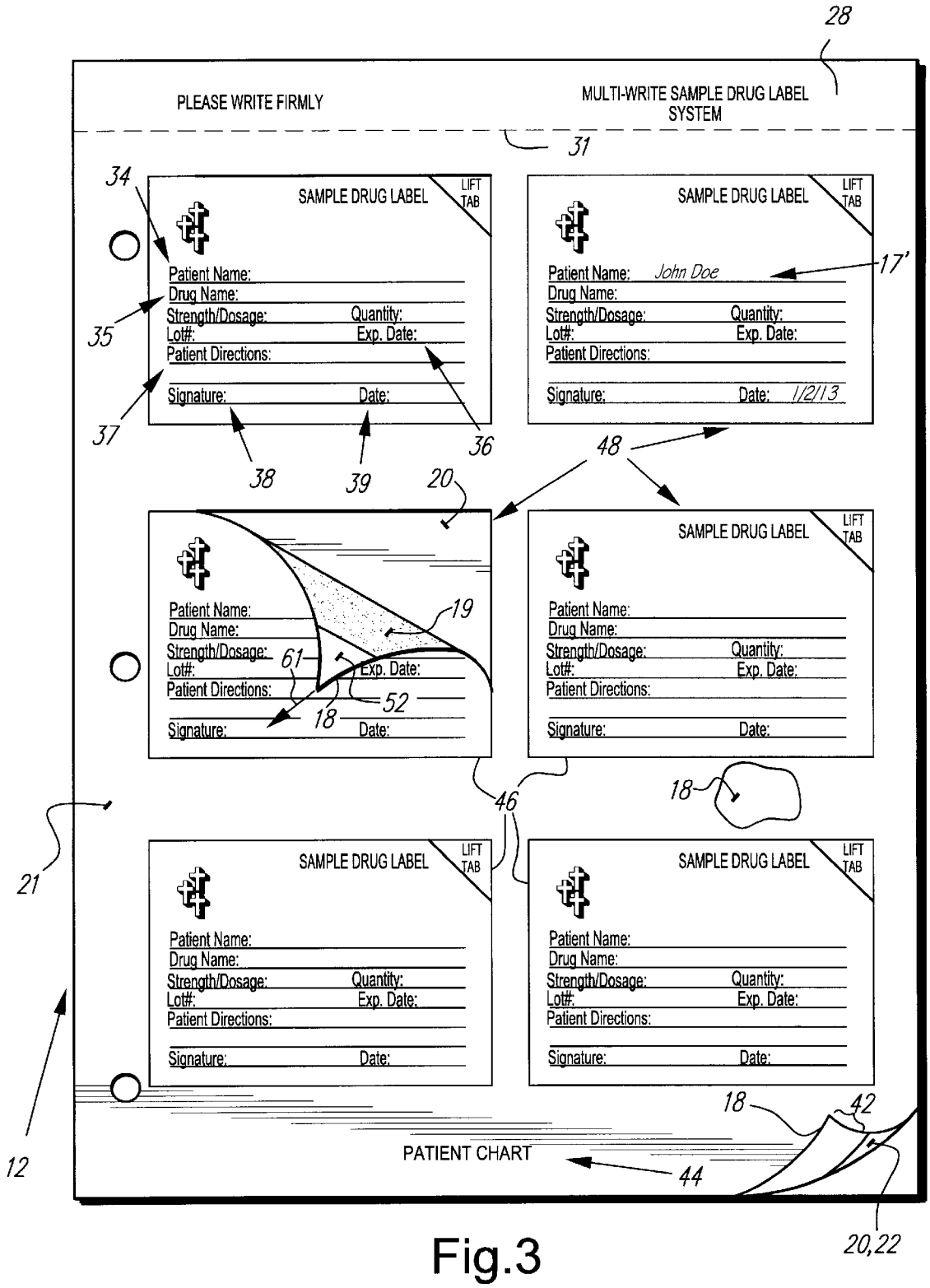
Figure 4:
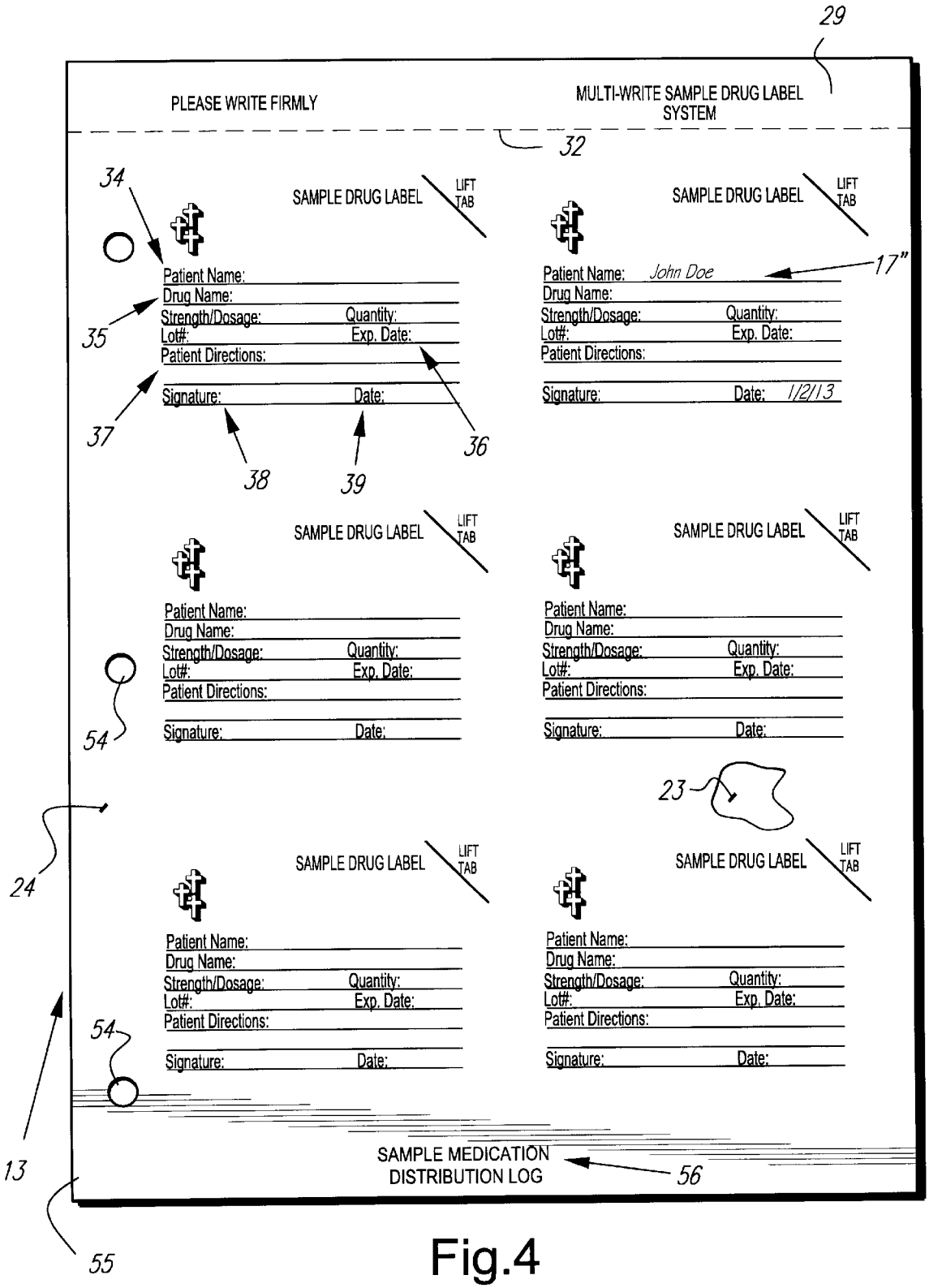
Figure 7:
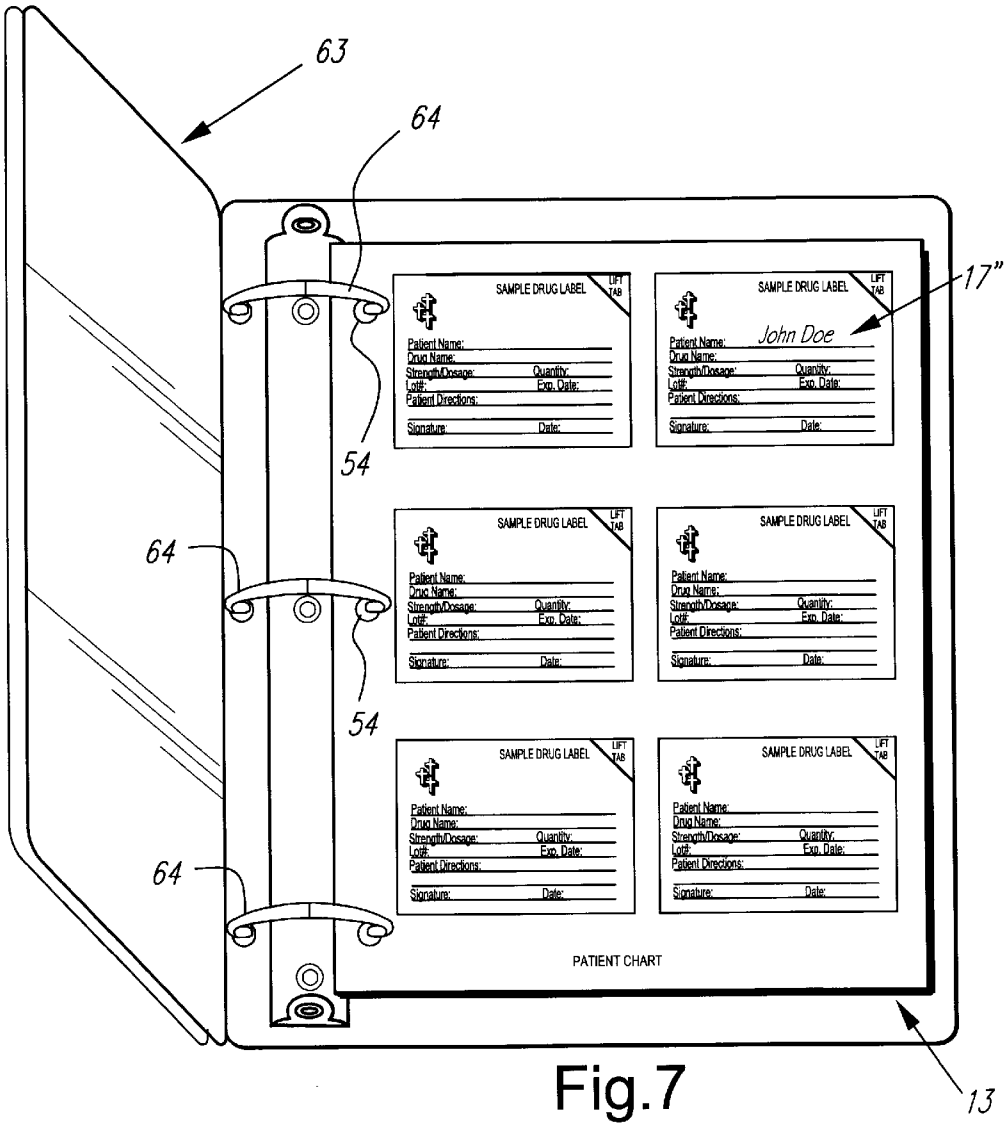
FIG. 7 is a top perspective view of the third part of FIG. 4 fastened in a sample medication distribution log.
Figure 5:
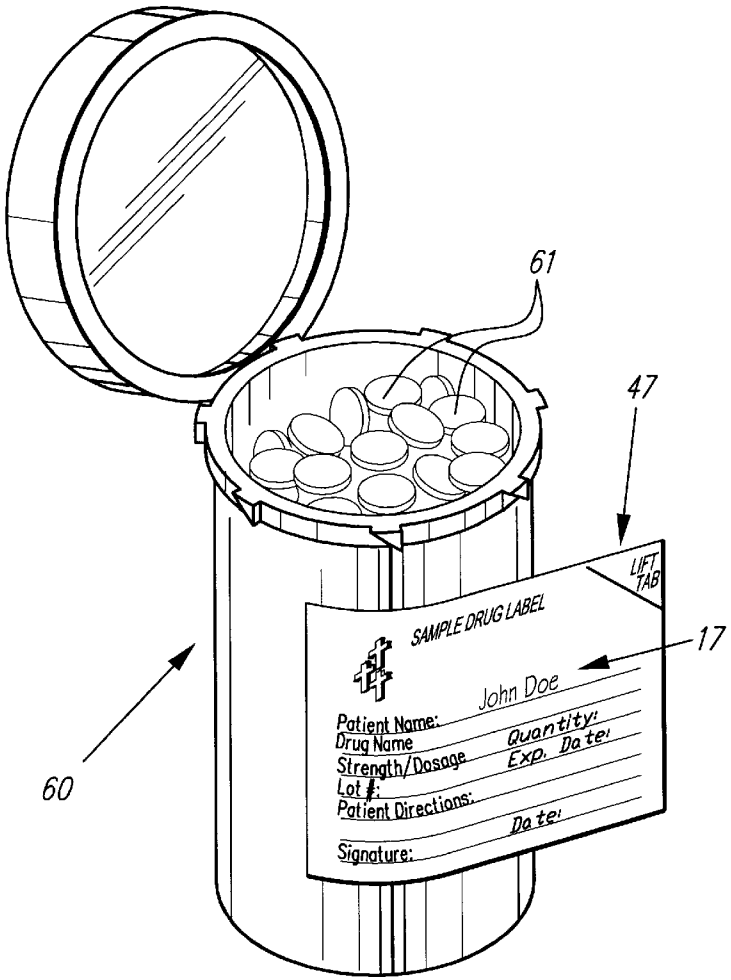
FIG. 5 is a schematic perspective view illustrating a label from the first part of FIG. 2 being placed on a container of sample drugs.

As seen in FIG. 1, the form 10 has a first, top, label part 11, a second, intermediate, label part 12, and a third, bottom, paper part 13. Substantially a top plan view of the first part 11 is illustrated in FIG. 2, substantially a top plan view of the second part 12 is illustrated in FIG. 3, and substantially a top plan view of the third part 13 is illustrated in FIG. 4.

As schematically illustrated in FIG. 1, the first, top, label part includes a face ply 14 having pressure sensitive adhesive 15 (preferably a conventional permanent pressure sensitive adhesive) which is pattern coated thereon, or pattern coated on the adhesive release coated conventional liner ply 16. The adhesive 15 has a much greater affinity for the back surface of the face ply 14 than it is does for the adhesive release coated liner ply 16. The face ply preferably is between about 10–18 pound bond paper, preferably about 13 pound bond paper, while the liner ply 16 is between about 10–15 pound liner paper, preferably about 13 pound liner paper. Image transfer means is associated with the top ply 14 for transferring variable indicia—such as the handwritten indicia 17 illustrated in FIG. 2—from the face ply 14 to the second part 12.

In the embodiment illustrated in FIG. 1 this image transfer means includes the CB layer 17 on the bottom of the liner ply 16. Alternatively, the layer 17 may be an OPAS layer available from Mead Corporation which is a self-contained carbonless coating which is essentially clear after it is applied. It can be applied using a flexographic printing process, and may be spot or pattern coated (that is it need not cover the entire back of sheet 17, but only portions that need the image transfer capability).

The second label part 12 comprises a face ply 18 having pressure sensitive adhesive 19 on a back surface thereof and in engagement with an adhesive release coated liner ply. The face ply 18 preferably is between 10–18 pound bond paper (e.g. 15 pound bond paper), and the liner ply 20 is preferably 10–15 pound liner ply (e.g. 13 pound liner ply), the pressure sensitive adhesive 19 is preferably substantially the same as the adhesive 15, although it may be of a different type if desired. For example the adhesive 19 may be removable or repositional pressure sensitive adhesive instead of permanent adhesive.

In the embodiment illustrated the image transfer means for transferring the image between the first part 11 and second part 12 also includes the CF coating 21 on the face ply 18 top surface, but if the layer 17 is a self-contained coating then the layer 21 is unnecessary. The image transfer means for the business form 10 further comprises, in the embodiment illustrated in FIG. 1, a CB or self-contained coating 22 on the liner ply 20 which transfers indicia from the second part 12 to the third part 13.

The third part 13 preferably comprises a sheet of bond paper 23, e.g. 10–25 pound bond paper, preferably about 15 pound bond paper. In the image transfer means embodiment of FIG. 1 a CF coating 24 is provided on the top face of the paper part 23 to cooperate with the CB coating 22 to transfer indicia from the second part 12 to the third part 13, but if coating 22 is self-contained then the coating 24 is unnecessary. FIGS. 3 and 4 illustrate how the variable indicia 17 imaged on the first part 11 is transferred as indicia 17' on the second part 12, and indicia 17" on the third part 13.

Instead of the image transfer means illustrated in FIG. 1 any other suitable image transfer means may be provided, such as self-contained coatings on the top surfaces of the ply 18 and part 23, or any other suitable conventional arrangement.

The parts 11–13 are releasably connected together, as illustrated schematically in FIG. 1 by the adhesive connectors 25, 26, which are preferably provided along the top edges 27, 28, 29, respectively, of the parts 11 through 13, respectively. Lines of weakness, such as the perforation lines 30, 31, 32, are provided between the adhesive 25, 26 and the rest of each of the parts 11–13. The adhesive 25, 26 may be any conventional adhesive, such as permanent pressure sensitive cohesive or adhesive, heat sealed adhesive or cohesive.

As seen most clearly in FIGS. 2 through 4, each of the parts 11–13 also has common non-variable indicia imaged thereon, on the face plies 14, 18 of the first and second parts 11, 12, respectively, and on the top surface of the third part 23. The non-variable indicia may be imaged on these plies/parts prior to the application of any other coating thereon, or after coating. For example, this common indicia includes, as illustrated in all of FIGS. 2–4, patient name 34, drug name 35, expiration date 36, directions 37, signature 38, signature date 39, etc. Of course any other indicia may also be provided such as the name and address of the clinic dispensing drugs utilizing the form 10, etc. The parts 11–13 are connected together by the adhesive 25, 26, or other connectors (such as staples, brackets, stakes, etc.) so that at least some of the common indicia 34–39 thereon is in alignment. For example, the "patient name" indicia 34 on each part 11, 12 and 13 is substantially exactly one atop the other in the form 10, which thus facilitates proper location of the variable indicia 17, 17', 17".

The liner plies 16, 20, do not necessarily have the same dimensions as the face plies 14, 18. For example as illustrated in FIG. 2, the liner ply 16 may have a length slightly less than that of the face ply 14 so that there is an unlined portion 41, and similarly for the portion 42 of the second part 12 (see FIG. 3). In the parts 41, 42 on the top face of each colored (e.g. red) identification and/or instruction indicia 43, 44 may also be imaged.

As seen in FIGS. 2 and 3, rather than there merely being one label in each of the label parts 11, 12, preferably a plurality of labels are formed in each of the parts 11, 12. For example six labels are shown in each of FIGS. 2 and 3. The labels are preferably formed by die cutting from the face plies 14, 18, respectively. The die cut lines are shown at 46 in each of FIGS. 2 and 3. The labels of the first part 11 are shown schematically and generally by reference numeral 47, while those in FIG. 3 are shown by reference numeral 48. In FIG. 2 the uppermost left label 47 is shown being peeled away to reveal the pressure sensitive adhesive 15 and the release liner 16 underneath it, while in FIG. 3 the middle left label 48 is being shown being pulled way to reveal the pressure sensitive adhesive 19 and the release liner 20.

For both of the label parts 11, 12 it is preferred that the adhesive 19 be pattern coated (either on the liner or on the back faces of the face plies) so as to leave an uncoated area of each of the face plies 14, 18 which facilitates separation of the labels 47, 48 from the plies 16, 20, respectively. For example the labels 47 have at the upper right corner thereof—where the "lift tab" indicia 49 is provided—an uncoated area 50, so that the corner of the face ply 14 at the area 50 can be grasped and used to pull the label 47 away from the liner 16 as indicated by the arrow 51 in FIG. 2. A similar area 52 is provided for the face ply 18 for each of the labels 48, as seen in FIG. 3.

In order to facilitate maintenance of the third ply in a binder, preferably it includes a plurality of holes 54 formed therein, e.g. adjacent the side edge 55 which is substantially perpendicular to the top edge 29. Like holes may be also be provided in the parts 11, 12, as illustrated in FIGS. 2 and 3.

While the third part 13 is shown in FIG. 4 having exactly the same indicia as the first parts 11, 12 since that is one simple way to construct the forms, of course some of the indicia (such as "lift tab" indicia 49 from FIG. 2) may be omitted since the part 13 is not a label part. Also the identification/instruction indicia 56 is preferably imaged thereon, typically in a different color than the other non-variable indicia 34–39.

With respect to FIGS. 2 through 7, the forms 10 are preferably, though not necessarily, used in a method of dispensing sample drugs, and record keeping therefor. In the practice of the method variable indicia 17 is imaged on the face ply 14 of one label 47 of the first part 11, including patient name indicia, so that the variable indicia is transferred to a label 48 of the second part 12 (the indicia 17') and to a portion of the third part 13 (indicia 17"). This is typically accomplished by handwriting with a ballpoint pen, pencil, or other impression writing instrument on the first part 11, or by using a typewriter. After a label 47 is completely imaged, the label 47 is removed from the first part 11, by grasping the non-adhesive portion 50 and pulling in the direction 51, and then it is placed on a container of sample drug, such as the container 60, with the drug 61 therein, illustrated in FIG. 5. The adhesive 15 is placed on the surface of the container 60 and pressed thereon to hold the label 47 in place.

The corresponding imaged label 48 of the second part 12 is then removed from the second part 12, as by grasping the non-adhesive portion 52 thereof and pulling in the direction 51, then that label 48 is placed on a patient chart 62 (see FIG. 6) for the same patient whose name is indicated by the indicia 17'. The above procedures are repeated for at least one other label of each of the parts 11, 12, and preferably for all six of the labels 47, 48 of each of the parts 11, 12. Then after all, or at least a plurality, of the labels 47, 48 are removed, the third part 13 is separated from the first and second parts 11, 12, as by tearing along the line of weakness (e.g. perforation line) 32, and the completed third part 13 is then placed in a sample medication distribution log binder 63 (see FIG. 7), so that mechanical fastening elements such as the conventional rings 64, pass through the openings 54.

It will thus be seen that according to the present invention a simple, effective, and virtually foolproof method and multi-part form have been provided, preferably for facilitating the dispensing and record keeping of sample drugs. While the invention has been herein shown and described in what is presently conceived to be the most practical and preferred embodiment thereof it will be apparent to those of ordinary skill in the art that many modifications may be made thereof within the scope of the invention which scope is to be accorded the broadest interpretation of the appended claims so as to encompass all equivalent structures and methods.

What is claimed is:

1. A multi-part business form comprising:

a first, top, label part including a face ply having pressure sensitive adhesive on a back surface thereof and in engagement with an adhesive release coated liner ply;

a second, intermediate, label part including a face ply having pressure sensitive adhesive on a back surface thereof and in engagement with an adhesive release coated liner ply;

a third, bottom, paper part;

common non-variable indicia imaged on said first part face ply, said second part face ply, and said third part, related to drug dispensing;

said first, second, and third parts releasably connected together so that at least some of said common indicia thereon is in alignment; and carbonless image transfer means for transferring indicia imaged on said first part face ply to said second part face ply and to said third part.

2. A business form as recited in claim 1 wherein said label parts each comprise a plurality of labels formed in said face ply thereof and each having non-variable common indicia.

3. A business form as recited in claim 2 wherein each label has a corner devoid of adhesive to facilitate easy separation from said liner ply.

4. A business form as recited in claim 3 further comprising holes formed in said third part remote from where said parts are releasably connected together, for mounting said third part in a binder.

5. A business form as recited in claim 4 wherein said holes are in a side edge of said third part when viewing said indicia thereon in a normal, upright, readable manner; and wherein said parts are releasably connected together at a top edge of each, substantially perpendicular to said side edge.

6. A business form as recited in claim 5 wherein said image transfer means comprise CB first and second part liner plies, a CF second part face ply, and a CF third paper part face in operative engagement with said second part CB liner ply.

7. A business form as recited in claim 6 wherein said pressure sensitive adhesive of said label parts is permanent adhesive, and wherein said parts are releasably connected together by permanent adhesive adjacent the top edge of each, and a line of weakness between said adhesive and the rest of each of said parts.

8. A business form as recited in claim 2 wherein said common indicia relates to the distribution of sample drugs, and wherein each of said plurality of first part labels is dimensioned to fit on a sample container of drugs, each of said plurality of second part labels is dimensioned to fit on a patient chart, and said third part is dimensioned to fit in a distribution log binder.

9. A business form as recited in claim 2 wherein said face plies of said first and second parts are each 10–18 pound bond paper, and wherein said liner plies of said first and second parts are each 10–15 pound liner paper.

10. A business form as recited in claim 2 wherein said image transfer means comprise self-contained carbonless coatings on said first and second part liner plies, or said second part face ply and said third paper part face in operative engagement with said second part liner ply.

11. A business form as recited in claim 1 wherein said face plies of said first and second parts are each 10–18 pound bond paper, and wherein said liner plies of said first and second parts are each 10–15 pound liner paper, and wherein said third part is 10–25 pound bond paper.

12. A method of dispensing sample drugs, and record keeping therefor, utilizing a multi-part business form comprising: a first, top, label part including a face ply having a plurality of labels formed therein and having pressure sensitive adhesive on a back surface thereof and in engagement with a liner ply; a second, intermediate, label part including a face ply having a plurality of labels formed therein and having pressure sensitive adhesive on a back surface thereof and in engagement with a liner ply; a third, bottom, paper part; common non-variable indicia imaged on the first part face ply, the second part face ply, and the third part related to drug dispensing; the first, second and third parts releasably connected together so that at least some of the common non-variable indicia thereon is in alignment; and carbonless image transfer means for transferring indicia imaged on the first part face ply to the second part face ply and to the third part; said method comprising:

(a) imaging variable indicia on the face ply of one label of the first part, including patient name indicia, so that the variable indicia is transferred by the image transfer means to a label of the second part, and a portion of the third part;

(b) removing the imaged label of the first part and placing it on a container of sample drugs;

(c) removing the imaged label of the second part and placing it on a chart for the patient whose name is imaged thereon;

(d) repeating (a)–(c) for at least one other label of each of the first and second parts; and (e) after a plurality of labels of the first and second parts have been removed, separating the third part from the first and second parts, and inserting the third part into a sample medication distribution log.

13. A method as recited in claim 12 wherein a corner of each of the plurality of labels has no pressure sensitive adhesive thereon; and wherein (b) and (c) are practiced by grasping the label at the corner with no adhesive, and pulling the label away from the liner while grasping that corner.

14. A method as recited in claim 12 wherein the third part has holes punched therein, and wherein (e) is practiced by placing the third part in a binder having fastening elements passing through the holes.

15. A method as recited in claim 12 wherein the parts are connected together along one edge thereof by permanent adhesive and a line of weakness; and wherein (e) is practiced in part by tearing along the line of weakness.

16. A method as recited in claim 12 wherein the face plies of the first and second part are 10–18 pound bond paper, and wherein the liner plies of the first and second parts are 10–15 pound liner paper, and wherein (a) is practiced by hand writing with an impression writing instrument.

17. A multi-part business form comprising:

a first, top, label part including a face ply having pressure sensitive adhesive on a back surface thereof and in engagement with an adhesive release coated liner ply;

a second, intermediate, label part including a face ply having pressure sensitive adhesive on a back surface thereof and in engagement with an adhesive release coated liner ply;

a third, bottom, paper part;

common non-variable indicia imaged on said first part face ply, said second part face ply, and said third part;

said first, second, and third parts releasably connected together so that at least some of said common indicia thereon is in alignment;

carbonless image transfer means for transferring indicia imaged on said first part face ply to said second part face ply and to said third part; and wherein said face plies of said first and second part are 10–18 pound bond paper, and wherein said liner plies of said first and second parts are 10–15 pound liner paper.

18. A business form as recited in claim 17 wherein said label parts each comprise a plurality of labels formed in said face ply thereof and each having non-variable common indicia.

19. A business form as recited in claim 18 wherein each label has a corner devoid of adhesive to facilitate easy separation from said liner ply, and wherein said third part is 10–25 pound bond paper.

20. A business form as recited in claim 18 further comprising holes formed adjacent a side edge of said third part when viewing said indicia thereon in a normal, upright, readable manner; and wherein said parts are releasably connected together at a top edge of each, substantially perpendicular to said side edge.

* * * * *